US009501905B2

(12) United States Patent
Bramble et al.

(10) Patent No.: US 9,501,905 B2
(45) **Date of Patent: *Nov. 22, 2016**

(54) GAMING MACHINE AND METHOD

(71) Applicant: Aristocrat Technologies Australia Pty Limited, North Ryde (AU)

(72) Inventors: Paul Francis Jason Bramble, Artarmon (AU); Brett Mezen, Holsworthy (AU)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 284 days.

This patent is subject to a terminal disclaimer.

(21) Appl. No.: 13/942,190

(22) Filed: Jul. 15, 2013

(65) Prior Publication Data

US 2013/0324215 A1 Dec. 5, 2013

Related U.S. Application Data

(63) Continuation of application No. 12/238,182, filed on Sep. 25, 2008, now Pat. No. 8,512,124.

(30) Foreign Application Priority Data

Sep. 27, 2007 (AU) ..... 2007905313

(51) Int. Cl.
*G07F 17/32* (2006.01)
*G07F 17/34* (2006.01)

(52) U.S. Cl.
CPC ..... *G07F 17/34* (2013.01)

(58) Field of Classification Search
CPC ..... G07F 17/32
See application file for complete search history.

(56) References Cited

U.S. PATENT DOCUMENTS

| | | | | |
|---|---|---|---|---|
| 4,448,419 | A | 5/1984 | Telnaes | |
| 5,890,962 | A | 4/1999 | Takemoto | |
| 6,270,412 | B1 | 8/2001 | Crawford et al. | |
| 6,652,378 | B2 | 11/2003 | Cannon et al. | |
| 6,893,342 | B1 | 5/2005 | Singer et al. | |
| 6,942,572 | B2 | 9/2005 | Inoue | |
| 2002/0183105 | A1 * | 12/2002 | Cannon | G07F 17/32 463/16 |
| 2007/0178965 | A1 | 8/2007 | Inoue | |

FOREIGN PATENT DOCUMENTS

| | | |
|---|---|---|
| AU | 2007202816 | 2/2008 |
| AU | 2007203311 | 2/2008 |
| AU | 2008200682 | 8/2008 |

* cited by examiner

*Primary Examiner* — Omkar Deodhar
(74) *Attorney, Agent, or Firm* — Armstrong Teasdale LLP

(57) ABSTRACT

A gaming machine for providing a game in which a plurality of symbols are selected and displayed in an array of symbol positions on a display, each symbol position associated with one or more of a plurality of regions and each region of the plurality of regions associated with a region specific award. The gaming machine comprises a user interface in communication with a game controller. If a winning combination of symbols occurs such that at least one of the symbols of the winning combination of symbols is displayed in a symbol position associated with a first region of said plurality of regions, the region specific award associated with the first region is awarded. If the same winning combination of symbols occurs such that at least one of the symbols of the winning combination of symbols is displayed in a symbol position associated with a second region of said plurality of regions, the region specific award associated with the second region is awarded.

43 Claims, 8 Drawing Sheets

GAMING MACHINE AND METHOD

CROSS-REFERENCE TO RELATED APPLICATIONS

This application is a continuation of and claims priority to patent application Ser. No. 12/238,182, filed on Sep. 25, 2008, entitled "GAMING MACHINE AND METHOD", which claims the benefit of priority to Australian Provisional Patent Application No. 2007905313, filed on Sep. 27, 2007, entitled "GAMING MACHINE AND METHOD", each of which is hereby incorporated by reference in its entirety for all purposes.

FIELD OF THE INVENTION

The present invention generally relates to gaming machines and methods of gaming. A particular embodiment of the present invention relates to the determination of prizes for winning combinations of symbols.

BACKGROUND OF THE INVENTION

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought after variety, while still developing games that comply with the relevant regulations in the jurisdiction of the gaming venue operator. Suppliers of gaming devices therefore are faced with restrictions on the types of games and gaming machines that are allowable, both in terms of the prevailing regulations and in terms of providing a return on investment to the gaming venue operators.

One conventional way in which awards for gaming devices are determined is by the concept of "paylines". In this case a player, prior to playing a game, places a wager on one or more paylines and if a winning combination of symbols (such as three of the same symbol in a row from left to right) occurs on a payline on which the player has placed an award is awarded.

SUMMARY OF THE INVENTION

In one aspect, the present invention provides a gaming machine configured to provide a game in which a plurality of symbols are selected and displayed in an array of symbol positions on a display, each symbol position associated with one or more of a plurality of regions and each region of the plurality of regions associated with a region specific award, the gaming machine including a user interface in communication with a game controller, wherein if a winning combination of symbols occurs such that at least one of the symbols of the winning combination of symbols is displayed in a symbol position associated with a first region of said plurality of regions, the region specific award associated with the first region is awarded, and if the same winning combination of symbols occurs such that at least one of the symbols of the winning combination of symbols is displayed in a symbol position associated with a second region of said plurality of regions, the region specific award associated with the second region is awarded.

Optionally, a region specific award will only be awarded if all of the symbols of the winning combination are displayed in symbol positions associated with that region.

Optionally, the symbol positions may be associated with different regions between successive plays of the game or during play of the game. Symbol positions may be associated with a region in accordance with a predetermined pattern, as the result of a random process, or due to the occurrence of a particular region altering symbol in a particular symbol position.

In one embodiment of the invention, symbol positions associated with different regions are displayed differently. For example, all symbol positions associated with the same region may be displayed in the same colour.

Optionally, the array of symbol positions may be included of a plurality of rows of symbol positions and a plurality of columns of symbol positions, each row having a leftmost symbol position and a rightmost symbol position and each column having a topmost symbol position and a bottommost symbol position.

In this case, at least one region may be included of a plurality of adjacent symbol positions displayed along a row or column of symbol positions, or included of all symbol positions displayed on two or more adjacent rows or columns Optionally, a region may be included of one or more of the following:

- a plurality of symbol positions displayed along a row or column of symbol positions, with at least two symbol positions separated by a symbol position which is not associated with that region;
- a plurality of adjacent symbol positions displayed along a row with at least one of the leftmost or rightmost symbol positions of that row not associated with that region;
- a plurality of adjacent symbol positions displayed along a column with at least one of the topmost or bottommost symbol positions of that column not associated with that region;
- a plurality of symbol positions displayed along a row with neither of the leftmost or rightmost symbol positions of that row associated with that region;
- a plurality of symbol positions displayed along a column with neither of the topmost or bottommost symbol positions of that column associated with that region.

Optionally, the award associated with a region may result in one or more of the following:

- the alteration of the region associated with at least one symbol position, the altered region association remaining for one or more subsequent plays of the game;
- the association of at least one additional symbol position to at least one region;
- the alteration of the region award associated with at least one region, the altered region award remaining for one or more subsequent plays of the game;
- multiplying a numeric amount that would normally be awarded by the winning combination by a predetermined amount;
- multiplying an accumulated numeric winnings total of a player of the game by a certain predetermined amount;
- the treatment of each symbol displayed in a symbol position belonging to the region as a wild symbol;
- awarding a player of the game with one or more free games of the game;
- maintaining the symbols displayed in the region in which the winning combination has occurred and redisplaying symbols in those symbol positions which are not associated with the region in which the winning combination has occurred;

launching one or more bonus games;

contributing a numeric amount to a jackpot

Optionally, the award associated with a region may change between successive plays of the game or during play of the game. The award associated with a region may change in accordance with a predetermined pattern, as the result of a random process, or due to the occurrence of a particular region award symbol in a particular symbol position.

Optionally, if a winning combination is such that all symbol positions of the winning combination are associated with more than one region, the controller may award each award associated with the regions in which the winning combination of symbols are displayed.

Each symbol position may be associated with more than one region.

In one embodiment the game is a virtual spinning reel game with n spinning wheels defining the columns of the array of symbol positions.

In another embodiment each symbol position of the array of symbol positions may be populated independently of each other symbol position.

In a second aspect, the present invention provides a method for use with a gaming machine that provides a game in which a plurality of symbols are selected and displayed in an array of symbol positions on a display, the gaming machine including a user interface in communication with a game controller, the method including the steps of:

associating each symbol position with one or more of a plurality of regions;

associating each region of the plurality of regions with a region specific award, awarding a first region award if a winning combination of symbols occurs such that at least one of the symbols of the winning combination of symbols is displayed in a symbol position associated with a first region of said plurality of regions, and awarding a second region award if the same winning combination of symbols occurs such that at least one of the symbols of the winning combination of symbols is displayed in a symbol position associated with a second region of said plurality of regions.

According to third aspect, the invention broadly resides in instructions executable by a game controller to implement the method as described in the immediately preceding paragraphs and to such instructions when stored in a storage medium readable by the game controller.

Further aspects of the present invention and further embodiments of the aspects described in the preceding paragraphs will become apparent from the following description, given by way of example and with reference to the accompanying drawings.

Figure 1:
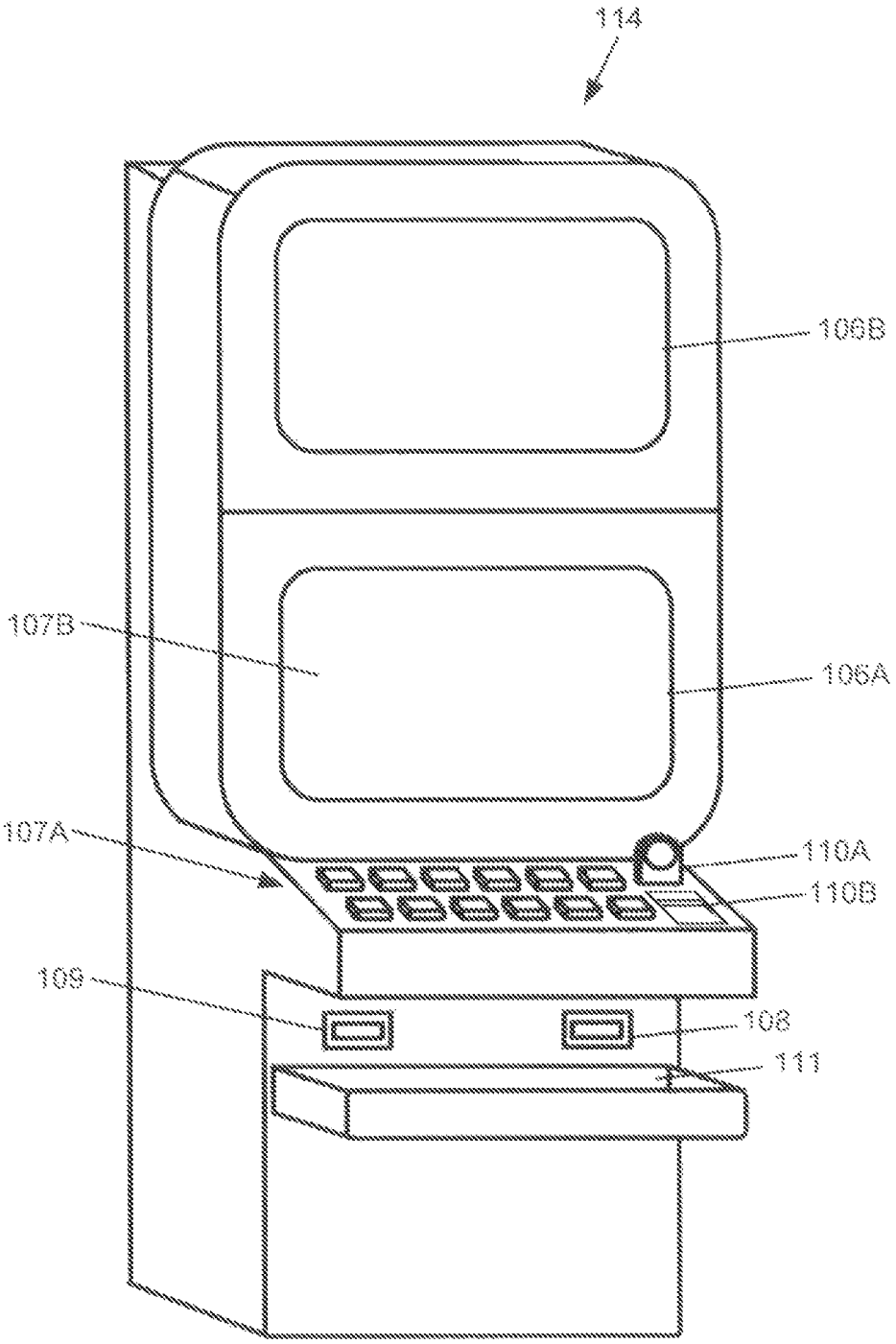
FIG. 1: shows diagrammatically, a view of a gaming console suitable for implementing certain embodiments of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE EMBODIMENTS

In FIG. 1 of the accompanying drawings, one example of a gaming console that is suitable to implement certain embodiments of the present invention is generally referenced by arrow 114.

The gaming console 114 includes two displays 106A, 106B on one or both of which is displayed representations of a game that can be played by a player and a bank of buttons 107A and/or a touch screen 107B to enable a player to play the game. The displays 106 may be video display units, such as a cathode ray tube screen device, a liquid crystal display, plasma screen, any other suitable video display unit, or the visible portion of an electromechanical device. The display 106B may display artwork, including for example, pay tables and details of bonus awards and other information or images relating to the game. In alternative gaming consoles the display 106B may be omitted, optionally replaced by a static display.

A credit input including a coin input 110A and/or bill collector 110B allows a player to provide credit for wagering and a coin output 111 is provided for cash payouts from the gaming console 114. A card and/or ticket reader 108 and a printer 109 may be provided to provide player tracking, cashless game play or other gaming and non-gaming related functions.

Figure 2:
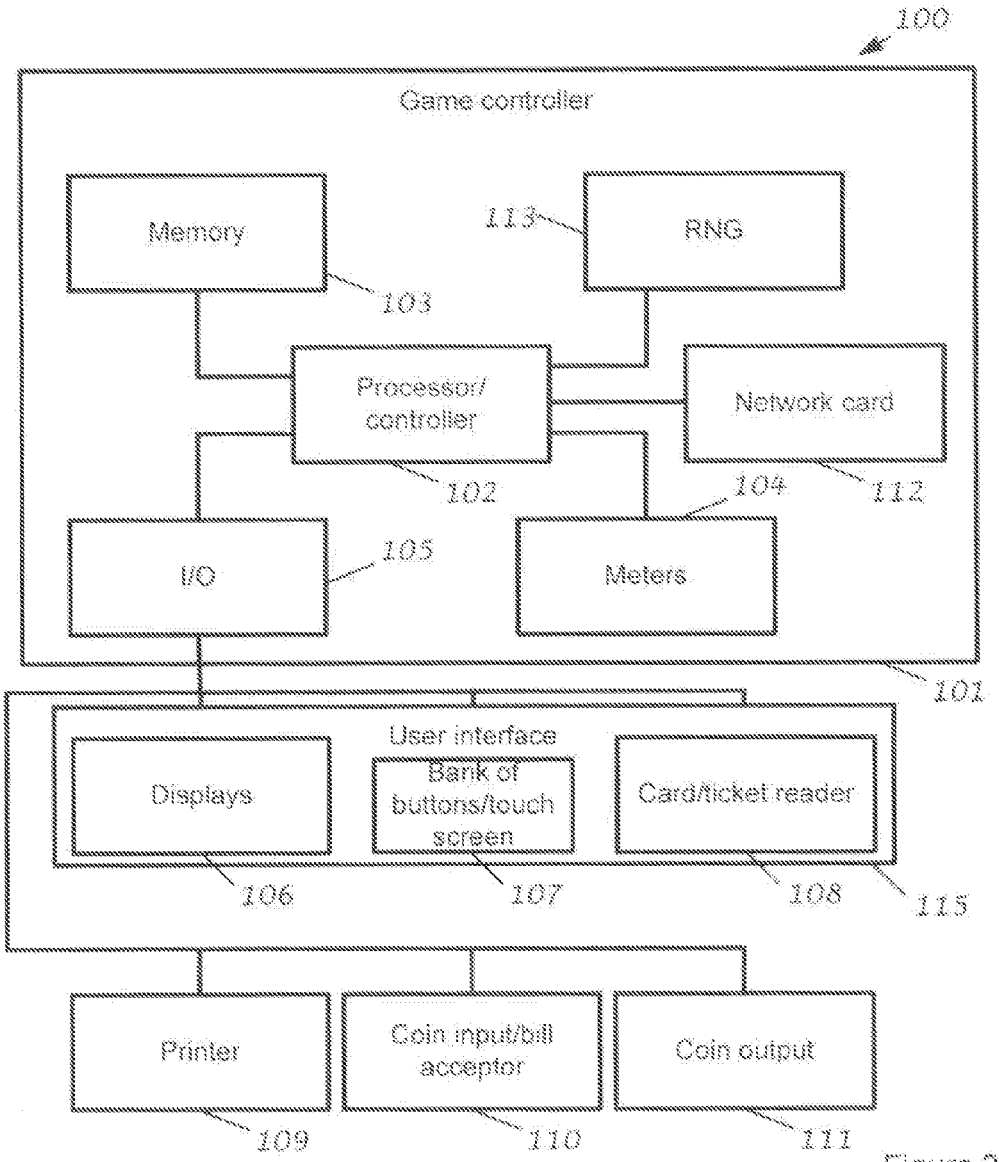
FIG. 2: shows a block diagram of gaming machine suitable for implementing certain embodiments of the present invention.

FIG. 2 shows a block diagram of a gaming machine, generally referenced by arrow 100, suitable for implementing certain embodiments of the present invention. The gaming machine 100 may include the gaming console 114 shown in FIG. 1 and accordingly like reference numerals have been used to describe like components in FIGS. 1 and 2.

The gaming machine 100 includes a game controller 101, which in the illustrated example includes a computational device 102, which may be a microprocessor, microcontroller, programmable logic device or other suitable device. Instructions and data to control operation of the computational device 102 are stored in a memory 103, which is in data communication with, or forms part of, the computational device 102. Typically, the gaming machine 100 will include both volatile and non-volatile memory and more than one of each type of memory, with such memories being collectively represented by the memory 103. The instructions to cause the game controller 101 to implement the present invention will be stored in the memory 103. The instructions and data may be conveyed to the gaming machine via a data signal in a transmission channel. Examples of such transmission channels include network connections, the Internet or an intranet and wireless communication channels.

The game controller 101 may include hardware credit meters 104 for the purposes of regulatory compliance and also include an input/output (I/O) interface 105 for communicating with the peripheral devices of the gaming machine 100. The input/output interface 105 and/or the peripheral devices may be intelligent devices with their own memory for instructions and data.

In the example shown in FIG. 2, the peripheral devices that communicate with the controller are the displays 106, bank of buttons/touch screen 107, the card and/or ticket reader 108, the printer 109, a bill acceptor and/or coin input 110 and a coin output 111. Additional devices may be included as part of the gaming machine 100, or devices omitted based on the specific implementation.

The bank of buttons 107A and/or touch screen 107B together with one or both of the displays 106 may provide a user interface 115 through which the gaming machine 100 and player communicate. If a card/ticket reader 108 is provided, this may also form part of the user interface 115.

In addition, the gaming machine 100 may include a communications interface, for example a network card 112. The network card 112, may for example, send status information, accounting information or other information to a central controller, server or database and receive data or commands from the central controller, server or database. The network card 112 may also enable communication with a central player account, allowing cashless gaming. One or more of the peripheral devices, for example the card/ticket reader 108 may be able to communicate directly with the network card 112. The network card 112 and the I/O interface 105 may be suitably implemented as a single machine communications interface.

The game controller 101 may also include a random number generator 113, which generates a series of random numbers that are used by the computational device 102 to determine the outcomes of games played on the gaming machine 100.

The game controller 101 may have distributed hardware and software components that communicate with each other directly or through a network or other communication channel. The game controller 101 may also be located in part or in its entirety remote from the user interface 115. Also, the computational device 102 may include a plurality of devices, which may be local or remote from each other.

Figure 3:
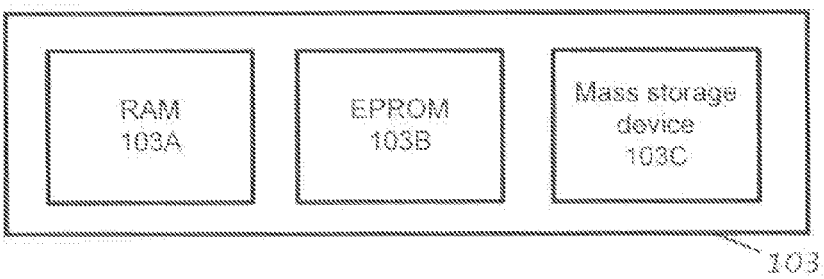
FIG. 3: shows a block diagram of components of the memory of the gaming machine represented in FIG. 2.

FIG. 3 shows an exemplary block diagram of the main components of the memory 103. The RAM 103A typically temporarily holds instructions and data related to the execution of game programs and communication functions performed by the computational controller 102. The EPROM 103B may be a boot ROM device and/or may contain system and game related code. The mass storage device 103C may be used to store game programs, the integrity of which may be verified and/or authenticated by the computational controller 102 using protected code from the EPROM 103B or elsewhere.

FIGS. 4A to 4D depict an example array 400 of symbol positions 406 which, during game play in accordance with an embodiment of the present invention, may be displayed by the game controller 101 on one or both of displays 106A and 106B. In the illustrated embodiment the array 400 is included of four rows 402A to 402D and five columns 404A to 404F. This 5×4 array provides a total of 20 possible symbol positions 406. It will, of course, be appreciated that while certain embodiments of the invention will be described with reference to a 5×4 matrix of symbol positions, different sized arrays, matrices or arrangements of symbol positions may be used.

When a game is played by a user (as described in more detail below) all symbol positions 406 are populated with game symbols using conventional techniques. For example, the game may be of a reel type with five virtual wheels corresponding to the five columns 404A to 404E. In this case the game controller 101 causes the reels to be "spun" before coming to a rest and populating each of the symbol positions 406 with symbols. Alternatively, each individual symbol position may be populated independently of each other symbol position. The virtual reels may in some embodiments be replaced by physical reels rotated by a stepper motor under the control of the game controller 101.

Figure 4A:
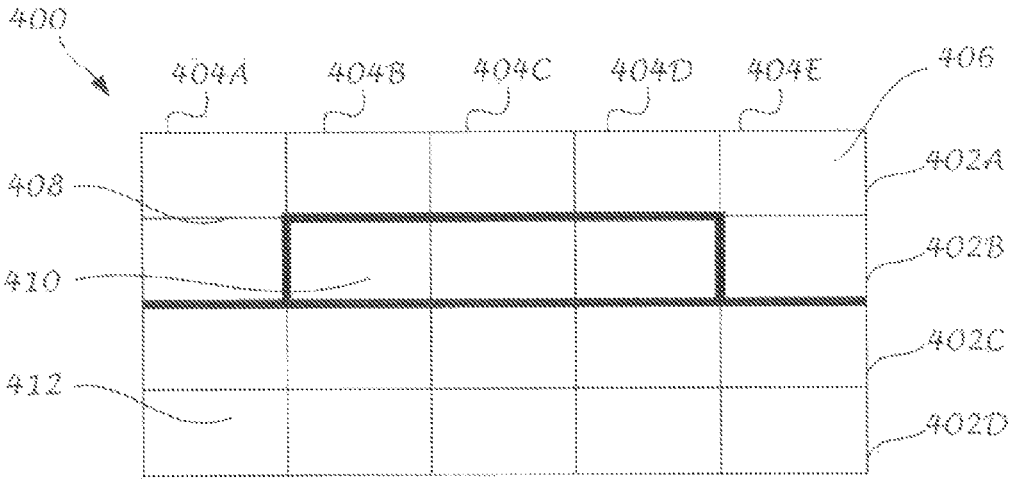
FIG. 4A: shows an example display screen divided into three distinct regions.
Figure 4B:
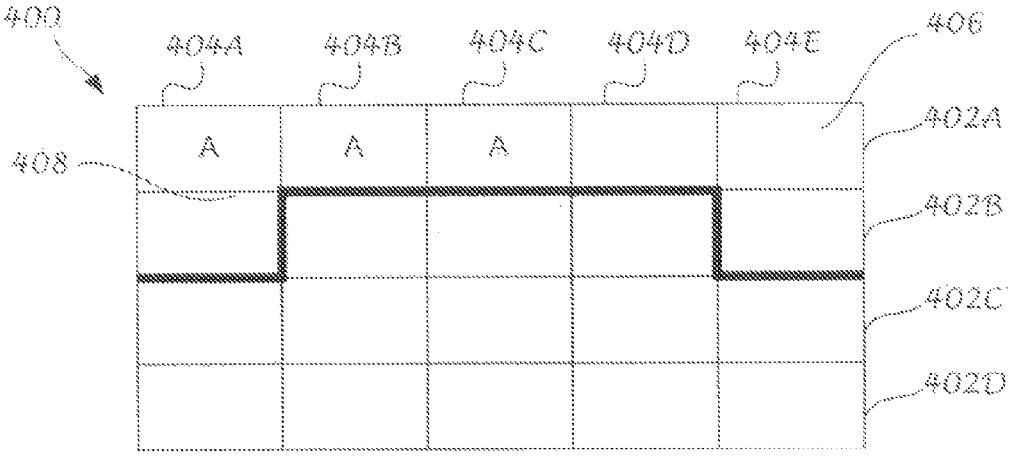
FIG. 4B: shows the display screen of FIG. 4A with a first region highlighted.

As can be seen in FIG. 4A, each symbol position 406 in the present embodiment is associated with one of three regions 408, 410, 412. This association may be performed by the game controller 101. In this example, region 408 includes row 402A and two symbol positions from row 402B (one taken from column 404A and one taken from column 404E); region 410 includes the middle three symbols locations of row 402B; and region 412 includes rows 402C and 402D.

The game controller 101 may keep track of which symbol positions 406 are associated with which region(s) by use of a look up table, database, or any other mapping function.

The game controller 101 is also configured to display the symbol positions 406 such that a player is able to discern which region(s) any particular symbol position 406 belongs to. For illustrative purposes this demarcation has been shown in the Figures by use of bolded lines. In one embodiment of the invention, however, the game controller 101 would demarcate the various regions by making all symbol positions 406 associated with the same region the same colour, and different to the colour of symbol positions 406 associated with a different region. Where a symbol position 406 is associated with more than one region (for example as discussed in relation to FIG. 7 below), a symbol position 406 may be coloured in more than one colour, each different colour representing membership of a different region.

Further, the game controller 101 may require a particular event in order for a region to become "active" (i.e. for the special properties of that region to operate). For example, at the beginning of game play regions 408, 410, and 412 may be inactive and have no effect on game play. If an activation event occurs (as discussed below) one or more of regions 408, 410, and 412 may be activated by the game controller 101 and, until deactivated, provide the region awards as discussed below.

For the purposes of the below discussion, a winning combination may be any predetermined arrangement of one or more specific types of game symbols. For example, a winning combination may be any 3 or more of the same symbol occurring in a straight line. Alternatively, a winning combination may be any 4 or more of the same symbols occurring in a block such that each symbol is adjacent to at least one other symbol of the same type in a horizontal direction (along a row) and at least one other symbol of the same type in a vertical direction (along a column).

In another alternative embodiment, a winning combination may be three or more like symbols occurring in the same region in adjacent columns, for example one in the symbol position 406 at the intersection of row 402D with column 404A, and the other two occurring in the intersection of row 402C with columns 404B and 404C. In this embodiment and the embodiment where winning combinations are defined by lines, the winning combination may be required to start from the leftmost side of the region. However, in other embodiments, there may be no restriction on where in a region the winning combination must occur.

In other embodiments, the game controller 101 may allow a player to wager on one or more "paylines". In this case a player is awarded when a winning combination occurs along a payline. By way of example only, FIG. 4E shows the array of symbol positions 400 with two paylines 416 and 418 represented. Payline 416 includes the symbol positions 406 at the intersections of: (404A and 402A), (404B and 402B), (404C and 402C), (404D and 402C), and (404E and 402C). Payline 418 includes the symbol positions 406 at the intersections of: (404A and 402D), (404B and 402D), (404C and 402D), (404D and 402D), and (404E and 402D).

In one embodiment, each region is associated with its own unique award characteristics. When a particular region is active, the game controller 101 is configured to award that region award when a winning combination occurs in the region. Unique in this sense refers to the fact that the region award for one region is different to the region awards of all other regions.

For example, if a winning combination such as three "A" symbols occurs in region 408 (e.g. FIG. 4B), the game controller 101 may be configured to award the player with a free play of the game. If instead of appearing in region 408 the winning combination of three "A" symbols occurs in region 410 (e.g. FIG. 4C), the game controller 101 may be configured to double the player's accumulated winnings instead of awarding the player with a free play of the game. In a still further alternative, if the winning combination of three "A" symbols occurs in region 412 (e.g. FIG. 4D), the game controller 101 may be configured to award the player with the different award of 20 additional credits.

As will be appreciated, this arrangement allows for the same winning combination of symbols to attract a different award depending on what region that winning combination occurs in.

Figure 5:
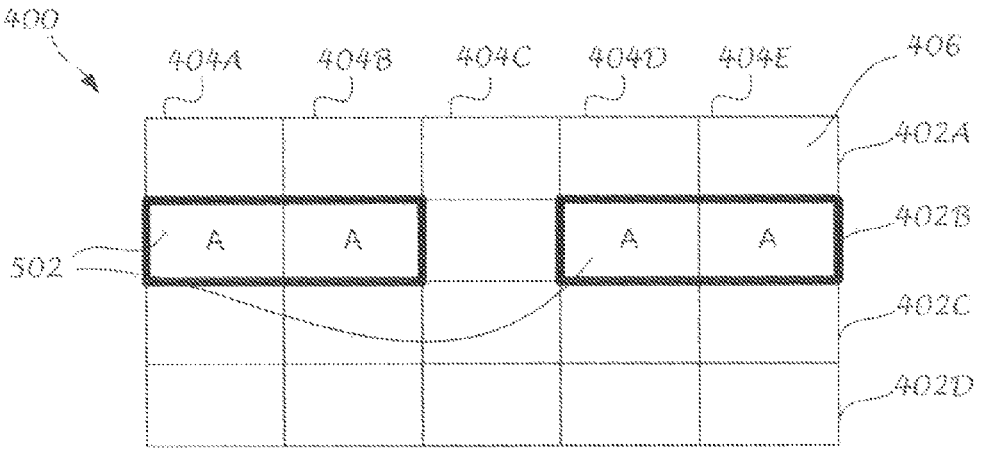
FIG. 5: shows an example display screen with a region of non-contiguous symbol positions.

As shown in FIG. 5, it is also possible for regions to be included of non-contiguous symbol positions. FIG. 5 depicts a region 502 which is included of all symbol positions on row 402B except the symbol location intersecting with column 404C.

Further, while three distinct regions have been discussed it is of course possible to implement more or less distinct regions as desired.

While in the examples discussed above in relation to FIGS. 4B to 4D the game controller 101 is configured to award a region award only if all symbols of a winning combination fall within the same region, the game controller 101 may, of course, be configured to award a region award for a winning combination if at least one of the symbols of the winning combination falls within a particular region. For example, FIG. 4F provides a representation of a game in which a player has wagered on paylines 416 and 418, and only region 410 is active. In this case the game controller 101 will award the player for the three "A" symbols falling along payline 416 as well as the occurrence of the three "A" symbols along payline 418. Further, because one of the "A" symbols on payline 416 falls within region 410 (i.e. the symbol at the intersection of 404B and 402B) the award normally associated with the occurrence of the three "A" symbols along payline 416 will be modified in accordance with the region award for region 410. This may, for example (and as discussed in more detail below) result in the normal award being doubled. In contrast, the award associated with the three "A" symbols occurring along payline 418 is not modified in any way as none of the symbols fall within an active region.

It will also be appreciated that the controller 101 may be configured to associate alternative reward characteristic with a particular region. Such awards may include (but are not limited to) any one or more of the following:

- multiplying the amount that would normally be won for the combination according to a paytable held in memory 103 by a certain amount (e.g. 2×, 3×, 4×, or the number of credits wagered)
- multiplying the accumulated win or total remaining credits of the player by a certain amount (e.g. 2×, 3×, 4×, or the number of credits wagered)
- making symbols of the region act as "wild" symbols (i.e. symbol which may be substituted for other symbols for the purposes of determining winning combinations)
- awarding the player with one or more free plays of the game, or one or more free plays of a bonus game
- awarding the player with the option of paying to play a bonus game
- awarding the player with a certain number of credits in addition to a payment made according to a paytable for the combination
- maintaining the symbols displayed in winning region and redisplaying those symbols not forming part of the winning region;
- contributing an amount to a jackpot
- activating one or more additional regions
- causing the boundaries of one or more regions to change, for example to increase the number of symbol positions associated with a region and provide a player an increased chance of achieving a winning combination in that region
- causing the prizes associated with one or more regions to change Region Activation and Deactivation As discussed above, the various regions may be activated and deactivated by the game controller 101. When a region is activated a player may, in accordance with the above discussion, achieve the region award associated with that region. When a region is deactivated no special region awards are achievable.

The game controller may be configured to activate a region on the occurrence of an activation event. Activation events may include, for example:

- a player placing a particular wager or wager of a particular amount
- the number of credits raising above a pre-determined threshold
- a player reaching a pre-determined amount of time playing the machine
- a player reaching a pre-determined cumulative wager on the machine
- the occurrence of a particular winning combination Region activations may also be random or pseudo-random events controlled by the game controller.

Similarly, the game controller may be configured to deactivate a region on the occurrence of a deactivation event. Deactivation events may include, for example:

the lapse of a pre-defined period of time since a region was activated the number of credits falling below a pre-determined threshold Region deactivations may also be random or pseudo-random events controlled by the game controller.

Dynamic Region Boundaries

For ease of reference the below discussion refers to the region boundaries and the movement of region boundaries. The boundary of any given region may be defined by the outer boundaries of the symbol positions which are members of that region.

The boundaries of a region may be "moved" by disassociating and reassociating symbol positions with that region. For example, in FIG. 4C the region boundary of region 410 is defined by the middle three symbol positions of row 402B. In order to "move" region 10 down a row (so that it appears to move to row 402C), the middle three symbols of row 402B would be disassociated with region 410, and the middle three symbols of row 402C would be associated with region 410.

Figure 4C:
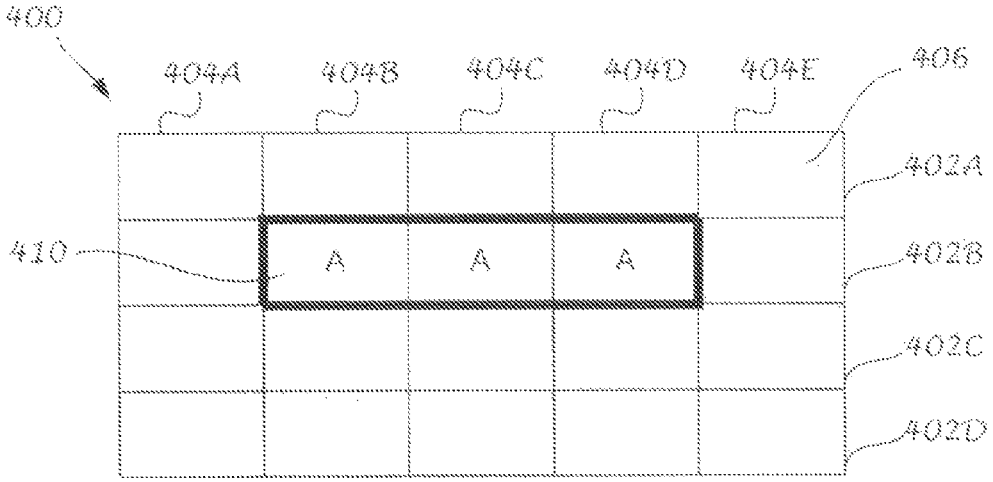
FIG. 4C: shows the display screen of FIG. 4A with a second region highlighted.
Figure 4D:
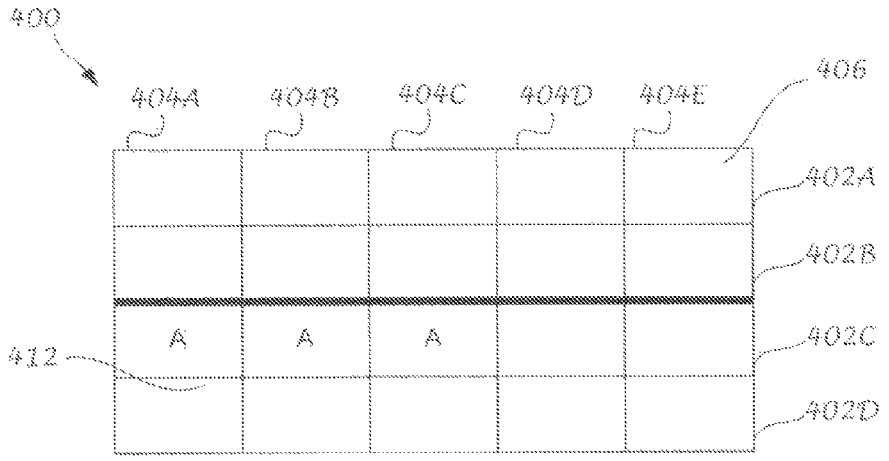
FIG. 4D: shows the display screen of FIG. 4A with a third region highlighted.
Figure 4E:
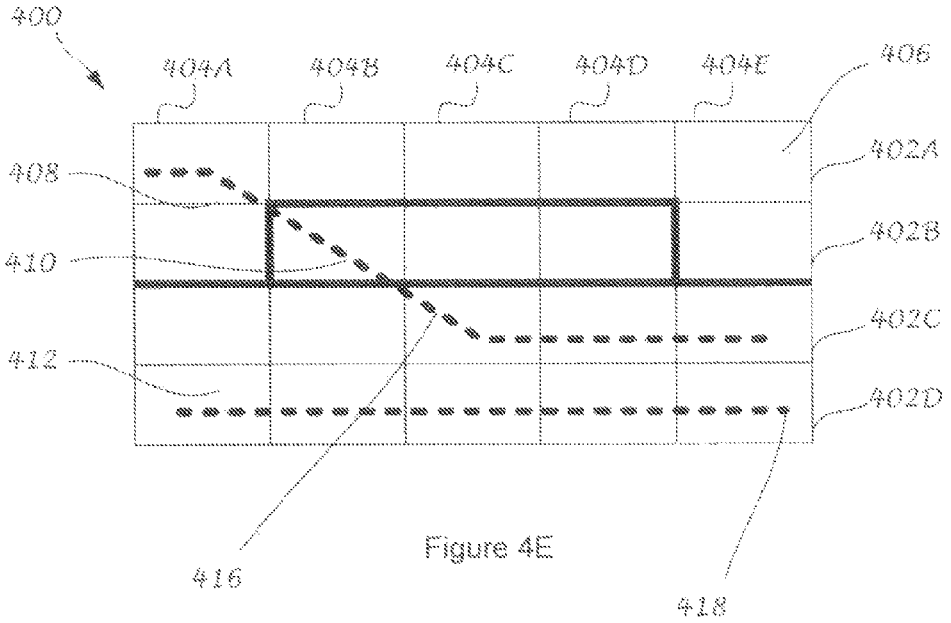
FIGS. 4E-4F: shows the display screen of FIG. 4A with various paylines represented.
Figure 4F:
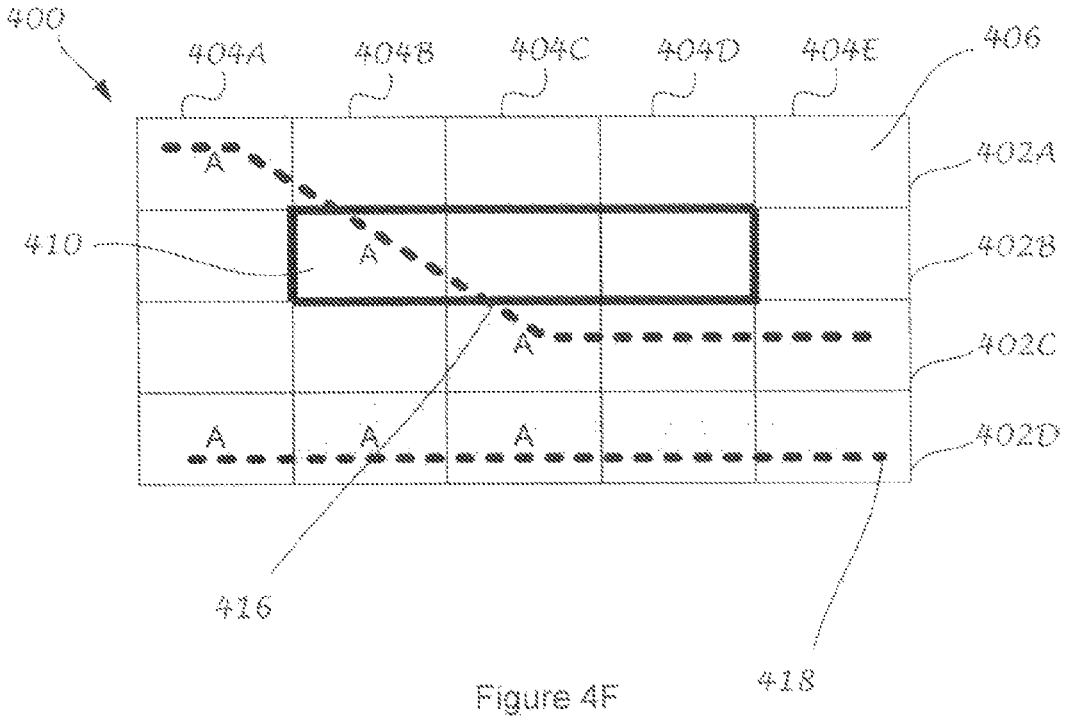

Similarly, if the desire was to expand region 410 as shown in FIG. 4C to encompass both the middle symbol positions of rows 402B and 402C, all that is required is to associate the middle three symbols of row 402C with region 410 (noting that the middle three symbols of row 402B are already associated with this region).

It will of course be appreciated that the particular boundaries of each of the regions need not be the same as those illustrated and discussed above, and need not be static. The boundaries of each of the regions may shift during or between game play thus changing the locations in which winning combinations must occur to qualify for the special region-associated awards.

For example, the game controller 101 may change the region boundaries in a predetermined and repeating pattern. An example of this would be for region 410 to be "moved" (as discussed above) from row to row between successive plays of the game: on the first play of the game region 410 may appear as the middle three symbol positions of row 402A; on the second play of the game the controller 101 could move region 410 to be the middle three symbol positions of row 402B; on the third play of the game region 410 could be moved to the middle three symbol positions of row 402C; and on the fourth play of the game to the middle three symbols of row 402D. On the fifth play of the game region 510 could then be returned to the middle three symbols of row 402A.

Alternatively, the game controller 101 may be configured to change the region boundaries on the occurrence of a certain winning combination, or the occurrence of a certain winning combination in a certain location or region. Using FIG. 4A as an example, a winning combination occurring in region 412 may trigger the game controller 101 to extend the boundaries of region 410 to encompass the middle three symbol positions of both rows 402B and 402C.

By way of further example, the membership of symbol positions to a particular region may be altered if a particular region altering symbol occurs adjacent an established region. Using FIG. 4C as an example, the established region is region 410. If on population of the symbol positions 406 with game symbols a region altering symbol is displayed in a symbol location 406 adjacent region 410 (i.e. in of the symbol positions at the intersection of [404B and 402A], [404C and 402A], [404D and 402A], [404A and 402B], [404E and 402B], [404B and 402C], [404C and 402C], or [404D and 402]) the game controller 101 may be configured to extend region 410 to include the symbol position in which the region altering symbol is displayed. For example, if a region altering symbol were displayed in the symbol position at the intersection of 404C and 402C, region 410 could be extended to include this position.

Alternatively, if a region altering symbol were displayed in the symbol position at the intersection of 404C and 402C, the game controller 101 could be configured to extend region 410 to include all symbol positions on row 402C corresponding to those symbol positions already a member of region 410 in region 402B (i.e. by adding symbol positions at the intersection of [404B and 402C], [404C and 402C], and [404D and 402C]).

If desired, different region altering symbols may be used by the game controller 101, with each region altering symbol only operative to extend one particular region (provided the symbol appears in a symbol location adjacent that region). Alternatively, the game controller 101 may provide a generic region altering symbol which operates to extend any region that the symbol is displayed adjacent to.

Game play with the extended region 410 is then as previously described, and may in fact allow for further region extension if another region altering symbol is displayed in a symbol position 406 adjacent the already extended region.

If a region altering symbol which operates to extend a particular region is displayed in a symbol position 406 which is already a member of that particular region the game controller 101 may be configured to remove that symbol position from the region. Alternatively, if a region altering symbol which operates to extend a particular region is displayed in a symbol position 406 which is already a member of that particular region the game controller 101 may be configured to change the nature of the award associated with that region.

The game controller 101 may also be configured to determine the symbol position membership of a particular region on a random or semi-random basis.

The change of region boundaries may be permanent, subsist until a winning combination occurs in the region which has been changed, or may only be applicable for the next play of the game, after which the game controller will return the region boundaries to their original location.

As can be seen, changing the region boundaries is advantageous in that it provides incentive for the player to continue playing the game.

The game controller may also be configured to change the region boundaries in response to a certain wager or option selected by a user, or at random.

Dynamic Region Awards

Just as the boundaries demarcating the different regions may change dynamically, so to may the awards associated with each region. The awards may change while the boundaries of the regions remain static, or the awards may change in combination with the changing of region boundaries as discussed above.

For example, the game controller 101 may change the awards associated with each region in a predetermined and repeating pattern. An example of this would be for the game controller 101 to cycle through a series of awards associated with a particular region on the basis of successive game plays. For example region 410 may be associated with an award of multiplying a players winnings by 2 on a first play, multiplying a players winnings by 2.5 on a second play, multiplying by 3 on a third play, then returning to multiplying by 2 on the fourth play. Alternatively, region 412 could be associated with the award of 20 additional credits on the first play, the award of a free spin on the second play, the award of doubling the player's winnings on the third play, and back to the award of 20 additional credits on the fourth play.

Alternatively, the game controller 101 may be configured to change the award associated with a particular region on the occurrence of a certain winning combination, or the occurrence of a certain winning combination in a certain location or region. For example, if a winning combination occurs in region 412 the controller may be configured to change the award associated with region 410 from doubling a player's winnings to tripling a player's winnings By way of further example, the award associated with a particular region may be altered if a particular region award symbol (with which a particular award is associated) is displayed in a symbol position which is a member of a region. Using FIG. 4C as an example, the established region is region 410. If on population of the symbol positions 406 with game symbols a region award symbol is displayed in a symbol location 406 within region 410 (i.e. in of the symbol positions at the intersection of [404B and 402B], [404C and 402B], [404D and 402B]), the region award for region 401 would be changed by the game controller 101 to be the region award associated with the region award symbol.

The change of award associated with a particular region may be permanent, may subsist until a winning combination occurs in the region for which the award has been changed, or may only be applicable for the next play of the game, after which the game controller will return the award associated with the region to its original setting.

Where an award associated with a particular region is changed, the game controller 101 may be configured to display the altered region award on one or both of displays 106A or 106B. As can be seen, changing the region boundaries is advantageous in that it provides incentive for the player to continue playing the game.

The game controller may also be configured to change the award associated with a region in response to a certain wager or option selected by a user or at random.

Combination Awards

As noted above, an award awarded as a result of a winning combination occurring in a region may be the only award awarded to a player, or may be awarded in combination with any standard awards offered by the game.

Figure 6:
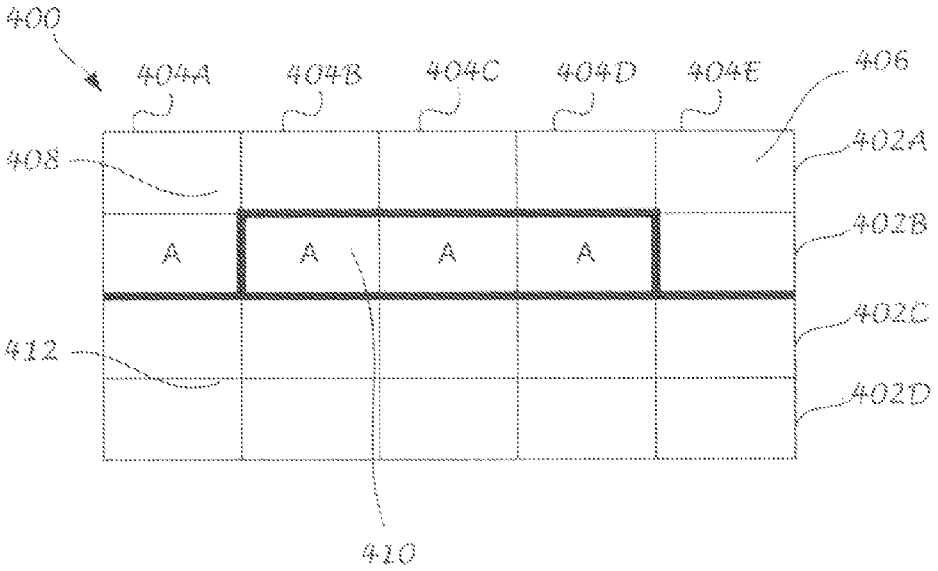
FIG. 6: shows a further example of a winning combination in accordance with an embodiment of the invention.

For example, and referring now to the array 400 depicted in FIG. 6, had a player wagered on the payline corresponding to row 402B on which 4 "A" symbols appear, the game controller 101 could be configured to award the player for the 4 "A" symbols occurring along the payline as well as award the player with the award associated with region 410 (for the occurrence of the winning combination of three "A" symbols in region 410).

Figure 7:
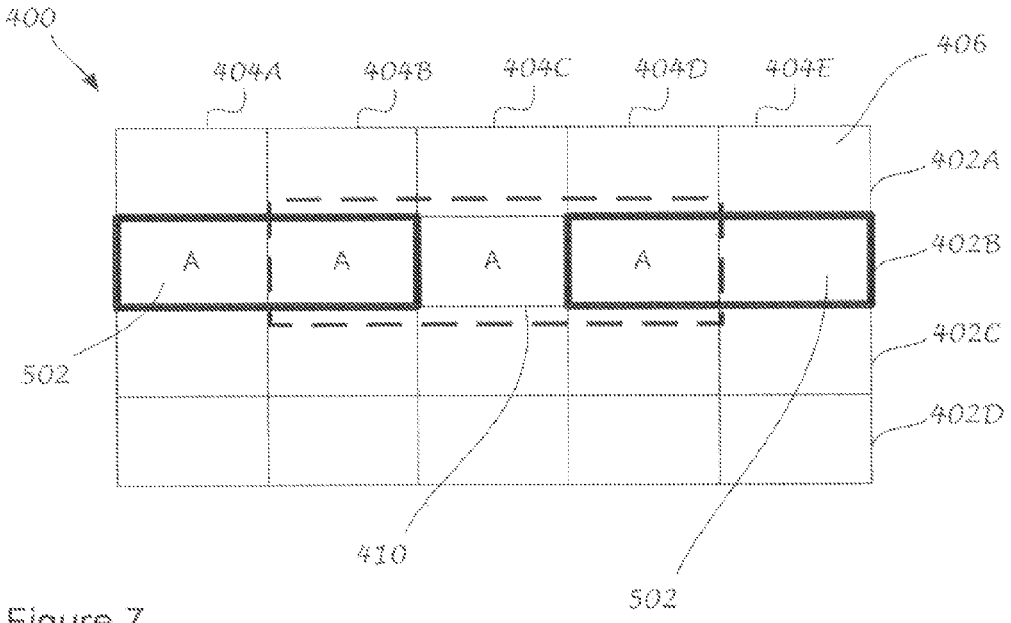
FIG. 7: shows an example of overlapping regions in accordance with an embodiment of the invention.

Further it is possible for different regions to overlap. FIG. 7 shows region 410 (in dotted lines for ease of visibility) which overlaps with region 502 (as described in relation to FIG. 5). In the depicted example, four "A" symbols have been displayed along row 402B. In this case the game controller 101 could be configured to award the award associated with the occurrence of a winning combination in region 502 (three "A" symbols in the region), as well as the award associated with the occurrence of a winning combination in region 410 (three "A" symbols in the region). Had the player wagered on the payline corresponding to row 402B the controller could also be configured to award the player for the occurrence of four "A" symbols occurring together along the payline.

If, for example, the region award associated with region 410 was to multiply any the value of any winning combination by 2× and the region award associated with region 502 were to multiply the value of any winning combination by 3×, the game controller 101 could be configured to combine these awards for a winning combination falling within both regions—e.g. by multiplying the award for the winning combination by 6× (multiplying the two region awards together) or by 5× (adding the two region awards together).

In line with conventional gaming technology, the game controller 101 may also be configured to award an award on the basis of winning symbol combinations occurring on selected paylines selected by the user. In this case the controller 101 may be configured to award the special region awards discussed above in addition to awarding awards based on paylines or any other known basis for awarding awards. Further, one or more region awards may be configured to modify an award associated with a payline.

Game Flow

Figure 8:
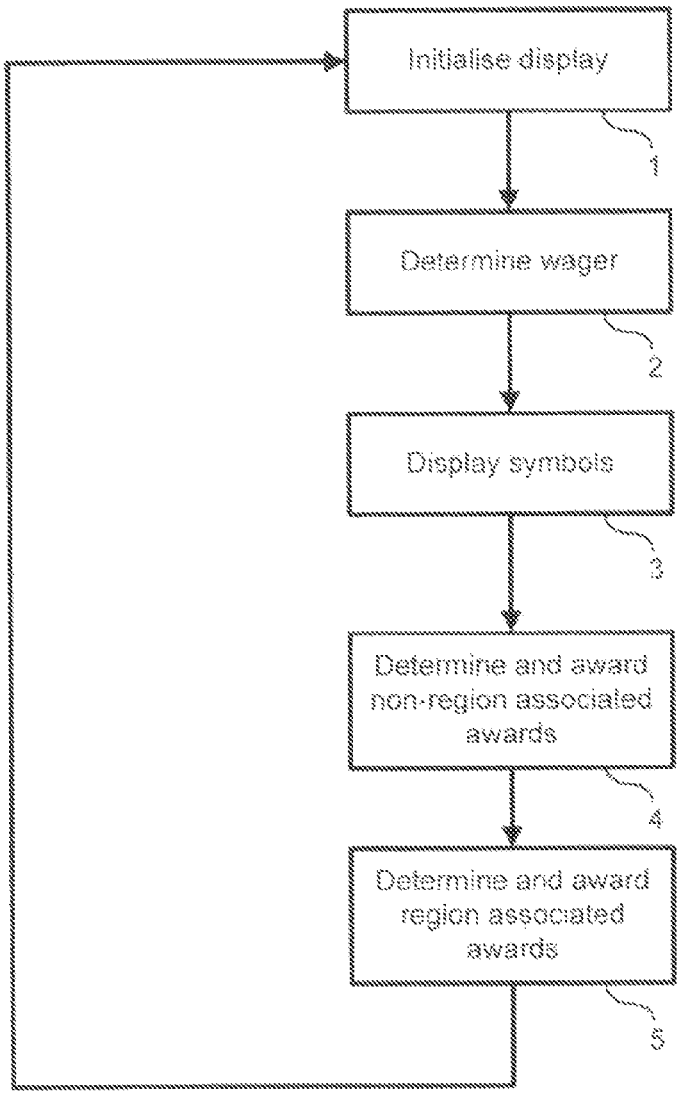
FIG. 8: shows a flow diagram of a process performed in accordance with an embodiment of the present invention.

FIG. 8 shows a process flow diagram of a process performed in accordance with an embodiment of the present invention. The process may be performed by the gaming machine 100, either as a stand-alone gaming machine, a linked gaming machine, or gaming machine having distributed components.

In step 1, the game controller 101 initialises either or both game displays 106A and 106B to display various different regions. As discussed above the different regions may be demarcated by providing each different region its own colour, by providing visible outlines or by any other appropriate indicator.

In step 2, the game controller 101 monitors the bill acceptor and/or coin input 110 and/or information received by the card/ticket reader 108 or network card 112 for a deposit of credit and in response causes the hardware meters 104 to increment according to the denomination of the game. The game controller 101 then monitors the user interface 107 for the input of a wager.

If there are sufficient credits in the meters 104 to support the wager, a game play is commenced in step 2 by the game controller 101.

In step 3, the game controller 101 populates each the symbol positions 406 with game symbols. As discussed above, this may be done by spinning and stopping virtual reels, or may be done by any other appropriate method.

In step 4, the game controller 101 determines and awards any non-region associated awards. These may, for example, be the occurrence of a winning combination along a payline on which a user has wagered. Step 4 is omitted in embodiments where the only awards are region awards.

In step 5, the game controller 101 determines and awards any special region associated awards. This involves the game controller 101 to determine whether a winning combination has occurred in a defined region that is active, determining the award associated with a winning combination occurring in that region and awarding that award to the player.

While the foregoing description has been provided by way of example of the preferred embodiments of the present invention as presently contemplated, which utilise gaming machines of the type found in casinos, those skilled in the relevant arts will appreciate that the present invention also may have application to internet gaming and/or have application to gaming over a telecommunications network, where handsets are used to display game outcomes and receive player inputs. Alternatively, the game may be performed on any other appropriate digital device such as a personal digital assistant (PDA) or a mobile phone.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Method steps associated with certain embodiments may be implemented in one embodiment by a program product including machine-executable instructions, such as program code, for example in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represents examples of corresponding acts for implementing the functions described in such steps.

The invention claimed is:

1. A gaming machine configured to provide a game in which a plurality of symbols are selected and displayed in an array of symbol positions on a display, each symbol position associated with one or more of a plurality of regions and each region of the plurality of regions being: (1) defined by at least one region boundary, the at least one region boundary defined by outer boundaries of the symbol positions that are members of that region, that is dynamically moveable such that the size of each region is dynamically adjustable, and (2) associated with a region specific award, the gaming machine comprising a user interface in communication with a game controller, wherein the region specific award associated with the first region is awarded when a winning combination of symbols occurs such that at least one of the symbols of the winning combination of symbols is displayed in a symbol position associated with a first region of said plurality of regions, and the region specific award associated with the second region is awarded when the same winning combination of symbols occurs such that at least one of the symbols of the winning combination of symbols is displayed in a symbol position associated with a second region of said plurality of regions.

2. A gaming machine according to claim 1, wherein the region specific award is only awarded if all of the symbols of the winning combination are displayed in symbol positions associated with that region.

3. A gaming machine according to claim 1, wherein the symbol positions are associated with different regions between successive plays of the game or during play of the game.

4. A gaming machine according to claim 3, wherein symbol positions are associated with a region in accordance with any one of a predetermined pattern, a random process, and the occurrence of a particular region altering symbol in a particular symbol position.

5. A gaming machine according to claim 1, wherein symbol positions associated with different regions are displayed differently.

6. A gaming machine according to claim 1, wherein all symbol positions associated with the same region are displayed in the same colour.

7. A gaming machine according to claim 1, wherein the array of symbol positions is comprised of a plurality of rows of symbol positions and a plurality of columns of symbol positions, each row having a leftmost symbol position and a rightmost symbol position and each column having a topmost symbol position and a bottommost symbol position.

8. A gaming machine according to claim 7, wherein the symbol positions associated with at least one region are selected from a group comprising:

a plurality of adjacent symbol positions displayed along a row of symbol positions; and a plurality of adjacent symbol positions displayed along a column of symbol positions.

9. A gaming machine according to claim 7, wherein the symbol positions associated with at least one region are selected from a group comprising: all symbol positions displayed on two or more adjacent rows; and all symbol positions displayed on two or more adjacent columns.

10. A gaming machine according to claim 7, wherein the symbol positions associated with at least one region are selected from a group comprising:

a plurality of symbol positions displayed along a row of symbol positions, with at least two symbol positions separated by a symbol position which is not associated with that region; and a plurality of symbol positions displayed along a column of symbol positions, with at least two symbol positions separated by a symbol position which is not associated with that region.

11. A gaming machine according to claim 7, wherein the symbol positions associated with at least one region are selected from a group comprising:

a plurality of adjacent symbol positions displayed along a row with at least one of the leftmost or rightmost symbol positions of that row not associated with that region;

a plurality of adjacent symbol positions displayed along a column with at least one of the topmost or bottommost symbol positions of that column not associated with that region;

a plurality of symbol positions displayed along a row with neither of the leftmost or rightmost symbol positions of that row associated with that region; and a plurality of symbol positions displayed along a column with neither of the topmost or bottommost symbol positions of that column associated with that region.

12. A gaming machine according to claim 1, wherein the award associated with a region is selected from a group comprising:

the alteration of the region associated with at least one symbol position, the altered region association remaining for one or more subsequent plays of the game;

the association of at least one additional symbol position to at least one region; and the alteration of the region award associated with at least one region, the altered region award remaining for one or more subsequent plays of the game.

13. A gaming machine according to claim 1, wherein the award associated with a region results in the multiplication of a numeric amount that would normally be awarded by the winning combination by a predetermined amount.

14. A gaming machine according to claim 1, wherein the award associated with a region is selected from a group comprising:

multiplying an accumulated numeric winnings total of a player of the game by a certain predetermined amount;

the treatment of at least one symbol displayed in a symbol position belonging to the region as a wild symbol; and awarding a player of the game with one or more free games of the game.

15. A gaming machine according to claim 1, wherein the award associated with a region is selected from a group comprising:

maintaining the symbols displayed in the region in which the winning combination has occurred and redisplaying symbols in those symbol positions which are not associated with the region in which the winning combination has occurred; and contributing a numeric amount to a jackpot.

16. A gaming machine according to claim 1, wherein the award associated with a region changes between successive plays of the game.

17. A gaming machine according to claim 1, wherein the award associated with a region changes during play of the game.

18. A gaming machine according to claim 16, wherein the award associated with a region changes in accordance with any one of a predetermined pattern, a random process, and the occurrence of a particular region award symbol in a particular symbol position.

19. A gaming machine according to claim 1, wherein each symbol position may be associated with more than one region.

20. A gaming machine according to claim 1, wherein the game is a virtual spinning reel game with n spinning wheels defining columns of the array of symbol positions.

21. A gaming machine according to claim 1, wherein each symbol position of the array of symbol positions is populated independently of each other symbol position.

22. A method for use with a gaming machine that provides a game in which a plurality of symbols are selected and displayed in an array of symbol positions on a display, the gaming machine comprising a user interface in communication with a game controller, the method including the steps of:

associating each symbol position with one or more of a plurality of regions, each region of the plurality of regions being defined by at least one region boundary, the at least one region boundary defined by outer boundaries of the symbol positions that are members of that region, that is dynamically moveable such that the size of each region is dynamically adjustable;

associating each region of the plurality of regions with a region specific award, awarding a first region award if a winning combination of symbols occurs such that at least one of the symbols of the winning combination of symbols is displayed in a symbol position associated with a first region of said plurality of regions, and awarding a second region award if the same winning combination of symbols occurs such that at least one of the symbols of the winning combination of symbols is displayed in a symbol position associated with a second region of said plurality of regions.

23. A method according to claim 22, wherein the region specific award is only awarded if all of the symbols of the winning combination are displayed in symbol positions associated with that region.

24. A method according to claim 22, wherein the symbol positions are associated with different regions between successive plays of the game or during play of the game.

25. A method according to claim 24, wherein symbol positions are associated with a region in accordance with any one of a predetermined pattern, a random process, and the occurrence of a particular region altering symbol in a particular symbol position.

26. A method according to claim 22, wherein symbol positions associated with different regions are displayed differently.

27. A gaming machine according to claim 22, wherein all symbol positions associated with the same region are displayed in the same colour.

28. A method according to claim 22, wherein the array of symbol positions is comprised of a plurality of rows of symbol positions and a plurality of columns of symbol positions, each row having a leftmost symbol position and a rightmost symbol position and each column having a topmost symbol position and a bottommost symbol position.

29. A method according to claim 28, wherein the symbol positions associated with at least one region are selected from a group comprising:

a plurality of adjacent symbol positions displayed along a row of symbol positions; and a plurality of adjacent symbol positions displayed along a column of symbol positions.

30. A method according to claim 28, wherein the symbol positions associated with at least one region are selected from a group comprising:

all symbol positions displayed on two or more adjacent rows; and all symbol positions displayed on two or more adjacent columns.

31. A method according to claim 28, wherein the symbol positions associated with at least one region are selected from a group comprising:

a plurality of symbol positions displayed along a row of symbol positions, with at least two symbol positions separated by a symbol position which is not associated with that region; and a plurality of symbol positions displayed along a column of symbol positions, with at least two symbol positions separated by a symbol position which is not associated with that region.

32. A method according to claim 28, wherein the symbol positions associated with at least one region are selected from a group comprising:

a plurality of adjacent symbol positions displayed along a row with at least one of the leftmost or rightmost symbol positions of that row not associated with that region;

a plurality of adjacent symbol positions displayed along a column with at least one of the topmost or bottommost symbol positions of that column not associated with that region;

a plurality of symbol positions displayed along a row with neither of the leftmost or rightmost symbol positions of that row associated with that region; and a plurality of symbol positions displayed along a column with neither of the topmost or bottommost symbol positions of that column associated with that region.

33. A method according to claim 22, wherein the award associated with a region is selected from a group comprising:

the alteration of the region associated with at least one symbol position, the altered region association remaining for one or more subsequent plays of the game;

the association of at least one additional symbol position to at least one region; and the alteration of the region award associated with at least one region, the altered region award remaining for one or more subsequent plays of the game.

34. A method according to claim 22, wherein the award associated with a region results in the multiplication of a numeric amount that would normally be awarded by the winning combination by a predetermined amount.

35. A method according to claim 22, wherein the award associated with a region is selected from a group comprising:

multiplying an accumulated numeric winnings total of a player of the game by a certain predetermined amount;

the treatment of at least one symbol displayed in a symbol position belonging to the region as a wild symbol; and awarding a player of the game with one or more free games of the game.

36. A method according to claim 22, wherein the award associated with a region is selected from a group comprising:

maintaining the symbols displayed in the region in which the winning combination has occurred and redisplaying symbols in those symbol positions which are not associated with the region in which the winning combination has occurred; and contributing a numeric amount to a jackpot.

37. A method according to claim 22, wherein the award associated with a region changes between successive plays of the game.

38. A method according to claim 22, wherein the award associated with a region changes during play of the game.

39. A method according to claim 37, wherein the award associated with a region changes in accordance with any one of a predetermined pattern, a random process, and the occurrence of a particular region award symbol in a particular symbol position.

40. A method according to claim 22, wherein each symbol position may be associated with more than one region.

41. A method according to claim 22, wherein the game is a virtual spinning reel game with n spinning wheels defining columns of the array of symbol positions.

42. A method according to claim 22, wherein each symbol position of the array of symbol positions is populated independently of each other symbol position.

43. A non-transitory computer readable storage medium storing instructions executable by a game controller to implement a method for use with a gaming machine that provides a game in which a plurality of symbols are selected and displayed in an array of symbol positions on a display, the gaming machine comprising a user interface in communication with a game controller, the method including the steps of:

associating each symbol position with one or more of a plurality of regions, each region of the plurality of regions being defined by at least one region boundary, the at least one region boundary defined by outer boundaries of the symbol positions that are members of that region, that is dynamically moveable such that the size of each region is dynamically adjustable;

associating each region of the plurality of regions with a region specific award, awarding a first region award if a winning combination of symbols occurs such that at least one of the symbols of the winning combination of symbols is displayed in a symbol position associated with a first region of said plurality of regions, and awarding a second region award if the same winning combination of symbols occurs such that at least one of the symbols of the winning combination of symbols is displayed in a symbol position associated with a second region of said plurality of regions.

* * * * *